United States Patent [19]

Ames

[11] 4,118,968

[45] Oct. 10, 1978

[54] SELF CLEANING PROGRESSIVE FIN DIE WITH IMPROVED STRIPPING MEANS

[75] Inventor: Ward A. Ames, Danville, Ill.

[73] Assignee: Tridan Tool & Machine, Inc., Danville, Ill.

[21] Appl. No.: 697,351

[22] Filed: Jun. 18, 1976

Related U.S. Application Data

[62] Division of Ser. No. 623,101, Oct. 16, 1975, Pat. No. 3,995,469.

[51] Int. Cl.[2] ..... B21D 45/00

[52] U.S. Cl. ..... 72/328; 72/344; 72/427

[58] Field of Search ..... 72/328, 347, 294, 427, 72/345, 344; 83/128, 49, 50, 620, 108, 687; 29/558

[56] References Cited

U.S. PATENT DOCUMENTS

| | | | |
|---|---|---|---|
| 987,144 | 3/1911 | Kuechenmieter | 83/108 |
| 1,396,230 | 11/1921 | Peterson | 83/128 |
| 1,818,332 | 8/1931 | Johnson | 72/328 |
| 2,369,551 | 2/1945 | Feiler | 83/687 X |
| 2,701,018 | 2/1955 | Glitsch | 72/328 |
| 2,772,735 | 12/1956 | Wakelee | 72/328 |
| 2,985,128 | 5/1961 | Henrickson | 72/328 |
| 3,733,879 | 5/1973 | Sellman | 72/336 |

*Primary Examiner*—Leon Gilden

*Attorney, Agent, or Firm*—Woodard, Weikart, Emhardt & Naughton

[57] ABSTRACT

A progressive fin die having means for preventing metal particle buildup around the punch with the means stripping the workpiece from the punch. A plurality of draw punches are arranged with decreasing diameters in a row. A ram is movable to and from the draw punches and includes a plurality of draw bushings. Movement of the ram toward the draw punches results in the punches forming bonnets in the workpiece positioned between the punches and bushings. Spring biased stripper rods extend through the bushings and are operable to force the workpiece from the bushings. A compound pierce and straightening station includes a hollow pierce bushing mounted to the frame for receiving a pierce punch movable to and from the frame by a ram. A straightening bushing encircles the pierce punch and is externally engageable with the bonnet formed by the draw punches. A stripper bushing is slidably mounted to the pierce punch and is disposed between the straightening bushing and the pierce punch. Spring means are provided to urge the stripper bushing to force the workpiece from the pierce punch.

1 Claim, 6 Drawing Figures

SELF CLEANING PROGRESSIVE FIN DIE WITH IMPROVED STRIPPING MEANS

This is a division of application Ser. No. 623,101 filed Oct. 16, 1975 now U.S. Pat. No. 3995,469.

BACKGROUND OF THE INVENTION

1. Field of the Invention

This invention is in the field of progressive fin dies.

2. Description of the Prior Art

Many heat transfer devices include plate type heat transfer fins having collared holes through which coolant tubes extend. The collared holes are produced by progressive fin dies which successively strike the fin to first draw the bonnet and then pierce and straighten the collar. The collared holes are then reflared with the fins then being cut and trimmed to the desired configuration.

The fin will normally stick in the straightening bushing as the ram is withdrawn unless an ejector or stripper is provided for forcing the fin from the punch. An ejector is shown in the U.S. Pat. No. 2,772,735 issued to R. L. Wakelee. The prior art ejectors leave a dimple in the relatively thin fin workpiece providing an undesirable appearance. Disclosed herein are two different embodiments of a stripper which contact the top edge of the collared holes in such a manner so as to leave the fin free of the dimples or marks and providing a blemish-free fin surface.

It is known to provide a compound collar straightening and piercing die. The prior art dies provide a pierce punch which is movable to and from a pierce bushing which extends into the bonnet. Simultaneously, a straightening bushing encircling the pierce punch is provided for externally engaging and straightening the collar. Metal particles accumulate between the pierce punch and the straightening bushing in the prior art devices since the pierce punch is spaced inwardly from the straightening bushing. Disclosed herein is a compound collar straightening and pierce die having a stripper bushing filling the space between the pierce punch and the straightening bushing preventing accumulation of metal particles and providing a self-cleaning pierce punch. Patents of interest in this field are the following: Nos. 2,763,228 issued to P. J. Lawson 3,146,749 issued to C. W. Heinle 3,367,164 issued to L. A. Franks et al

SUMMARY OF THE INVENTION

One embodiment of the present invention is a die for forming a collared hole in a plate type heat transfer fin comprising a frame including a surface for supporting the fin and a ram movable to and from the surface, a hollow pierce bushing mounted to the frame and extendable into a bonnet of the fin, a pierce punch mounted to the frame being extendable through the fin and into the bushing positioned in the bonnet forming a hole, a collar straightening bushing mounted to the frame and encircling the punch with a space therebetween, the straightening bushing externally engaging and encircling the bonnet as the punch and the pierce bushing extend into the bonnet forming a collar, a stripper bushing slidably disposed between the punch and the straightening bushing filling the space and cooperatively with the collar keeping the space free of metal particles from the piercing of the fin and spring means engaged with the frame and the stripper bushing being operable to force the fin from the bushing as the ram is withdrawn.

Another embodiment of the present invention is a stripper device for a die apparatus comprising a frame including a surface for supporting a workpiece and a ram movable to and from the surface, a hollow bushing fixedly mounted to the frame, a punch fixedly mounted to the frame and sized to force a portion of the workpiece in the bushing when the ram moves toward the surface, a stripper rod mounted to the frame and being positioned within the bushing and spring means engaged with the frame and the rod being operable to urge the rod through the bushing to force the portion of the workpiece therefrom as the ram moves away from the surface but being yieldable to allow the rod to withdraw within the bushing as the portion of the workpiece is forced into the bushing by the punch.

It is an object of the present invention to provide means for stripping the workpiece from a punch or bushing without marring the surface of the workpiece.

A further object of the present invention is to provide a compound collar straightening and piercing die for producing collared holes in a workpiece with means provided to prevent accumulation of metal particles around the pierce punch.

Another object of the present invention is to provide an improved self-cleaning punch.

In addition, it is an object of the present invention to provide a progressive fin die for providing collared holes of superior dimensional characteristics in a workpiece.

In conjunction with the above objects, it is an object of the present invention to provide a progressive fin die design operable at higher speeds as compared to prior art devices.

Related objects and advantages of the present invention will be apparent from the following description.

DESCRIPTION OF THE PREFERRED EMBODIMENT

Figure 1:
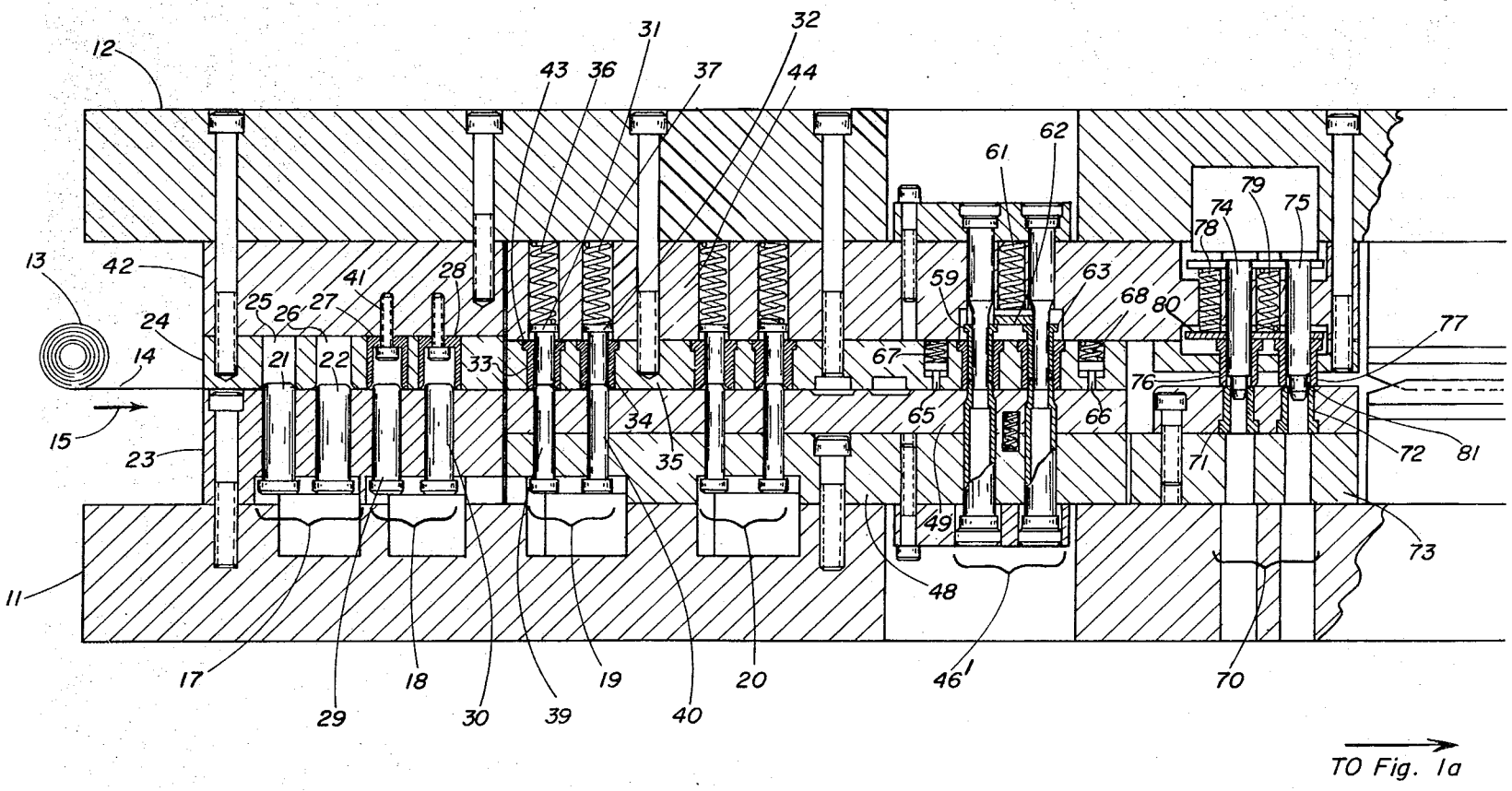
FIG. 1 is a cross-sectional view of the left portion of progressive die for producing fins having collared holes. The right portion of the progressive die is shown in FIG. 1*a*.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1A:
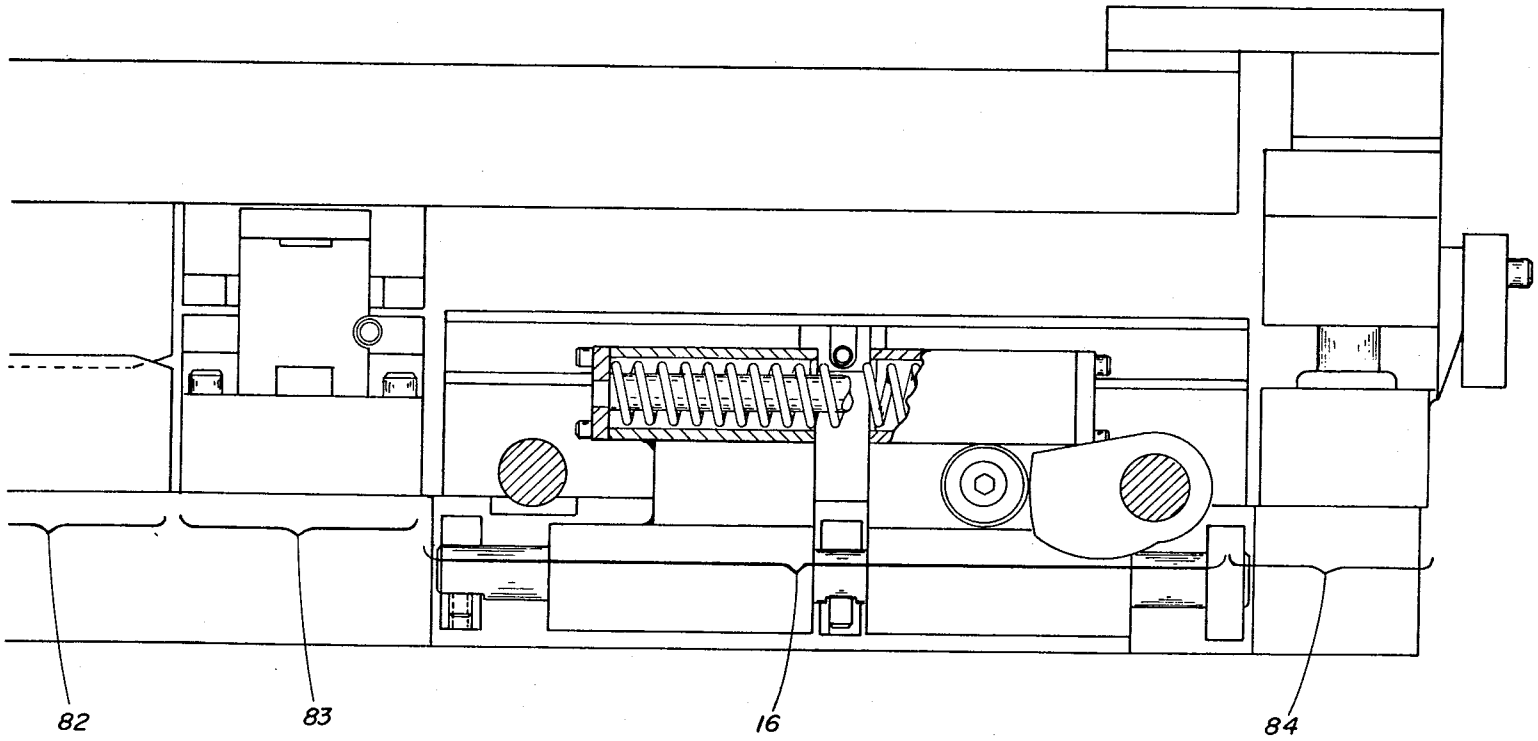

Referring now more particularly to FIGS. 1 and 1*a*, there is shown a progressive fin die having a main frame 11 with plates 12 and 45 attached to a ram vertically movable to and from the frame. A roll 13 of sheet metal 14 extends into the die in the direction of arrow 15. Most fins are produced from aluminum sheet; however, other materials used for producing fins include copper, steel, cupro-nickel and other brass alloys. The range of material thickness employed for the sheet material is between 0.004 and 0.015 inches. The progressive fin die is provided with means 16 for feeding sheet 14 through the die in timed relationship with the movement of plate 12. Thus, the formations provided in sheet 14 by the various punches will be aligned with successive punches as the sheet is pulled through the die.

In the preferred embodiment of die shown in FIGS. 1 and 1*a*, four draw stations 17, 18, 19 and 20 are provided. Each draw station includes a draw punch which is fixedly mounted to the frame in opposite relationship to a hole or draw bushing provided on the ram. The purpose of the draw station is to form a circular dome or bonnet in material 14. Generally, there are two or more progressive draw stations in fin dies and in some cases include as many as five draw stations. The height of each bonnet or dome formed in material 14 by the draw punches is the same from draw station to draw station; however, the diameters of the draw punches decrease progressively from station 17 to station 20. That is, the diameter of each draw punch provided in station 17 is larger than the diameter of each draw punch provided in station 18 with the smallest diametered draw punch being provided in station 20. The final draw station reduces the diameter of the bonnet or dome to the final required diameter. The bonnets subsequently are pierced and straightened forming collared holes.

In the embodiment of the fin die shown in the drawings, each draw station is provided with a pair of draw punches. For example, draw station 17 includes draw punches 21 and 22 fixedly mounted to plate 23 of frame 11. Top shoe 24 mounted to plate 12 includes a pair of holes 25 and 26 which receive the draw punches 21 and 22 as the punches initially form the bonnets in material 14. Station 18 is provided with a pair of draw bushings 27 and 28 fixedly mounted to shoe 24 with the bushings receiving the bonnets formed by draw punches 29 and 30. Feed device 16 is operable to pull material 14 through the fin die in such a manner so as to locate the bonnet formed by draw punch 21 immediately over draw punch 29 on the next successive reciprocation of the ram thereby bypassing draw punch 22. Likwise, the bonnet formed by draw punch 22 bypasses draw punch 29 and is located over draw punch 30 on the next reciprocation of the ram.

Stripper means are used to force the bonnets from the draw bushing as the diameter of the collar is reduced. For example, a pair of stripper rods 31 and 32 are respectively slidably mounted in bushings 33 and 34 fixedly mounted to top shoe 35 attached to the ram. A pair of helical springs 36 and 37 are disposed in cavities of plate 44 located immediately above shoe 35. The helical springs are operable to force the enlarged top head of each stripper rod downwardly thereby forcing the workpiece from bushings 33 and 34. Draw punches 39 and 40 are fixedly mounted to frame 11 and extend upwardly into bushings 33 and 34 as the ram moves downwardly toward frame 11. Station 20 is identical to station 19 with the exception that the outside diameter of the draw punches are reduced as compared to station 19 and with the additional exception that the inside diameter of the bushings of station 20 are smaller as compared to station 19.

Draw bushings 27 and 28 are fixedly mounted by fasteners 41 to plate 42 in turn fixedly mounted to shoe 24. The draw bushings for stations 19 and 20 are provided with enlarged top ends 43 received in cylindrical recesses provided in shoe 35. Plate 44 is fixedly fastened to shoe 35 and abuts against the top ends 43 of the draw bushings preventing the draw bushings from disengaging shoe 35. The springs provided for stations 19 and 20 are engaged and disposed between plate 12 fixedly mounted to plate 44 and the top ends of the stripper rods. The springs provide means operable to urge the stripper rods through the draw bushings to force the workpiece from the draw bushings as the ram moves away from the top surface of frame 11. Likewise, the springs are yieldable to allow the stripper rods to withdraw within the draw bushings as the workpiece is forced into the draw bushings by the draw punches. The draw bushings and punches are arranged in aligned rows with the draw punches having decreasing outside diameters corresponding with the decrease in internal diameters of the draw bushings.

Figure 4:
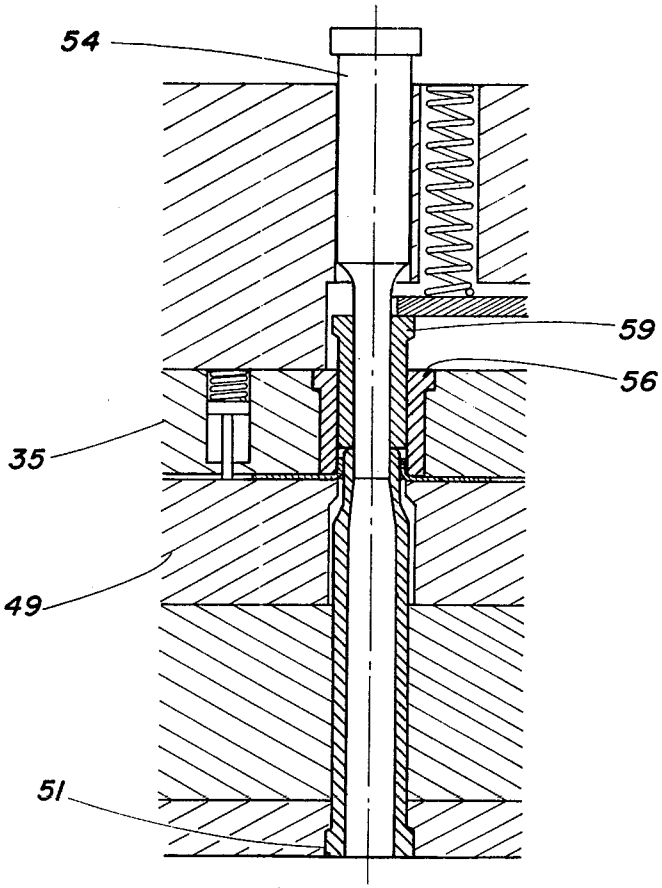
FIG. 4 is the same view as FIG. 3 only showing the die in the closed position.

A compound collar straightening and pierce station 46 is provided with a pair of pierce punches, a pair of collar straightening bushings and a pair of stripper bushings. The compound collar straightening and pierce station 46′ is shown in the open position in FIG. 2 and in the closed position in FIGS. 1 and 4. Frame 11 includes a pair of plates 47 and 48 fixedly secured together with bottom shoe 49 positioned atop plate 48 and urged upwardly by a plurality of springs 50 disposed therebetween. A hollow pierce bushing 51 is fixedly mounted to plate 48 and extends upwardly into hole 52 of shoe 49. With the ram in the upward position, spring 50 urges plate 48 from shoe 49 thereby positioning the top edge 53 of pierce bushing 51 immediately beneath the supporting surface 46 of the frame. Thus, the fin stock 14 may be moved across the supporting surface without interference with pierce bushing 51.

Pierce punch 54 is fixedly mounted to plate 44 and extends downwardly through shoe 35 having a bottom end 55 positioned flush with the bottom surface of shoe 35. Shoe 35 in turn is fixedly mounted to plate 44. A collar straightening bushing 56 is fixedly secured within shoe 35 having an enlarged top end 57 received in a recess provided in shoe 35 with plate 44 abutting the top end 57 of the bushing preventing relative motion between bushing 57 and plates 35 and 44.

Figure 2:
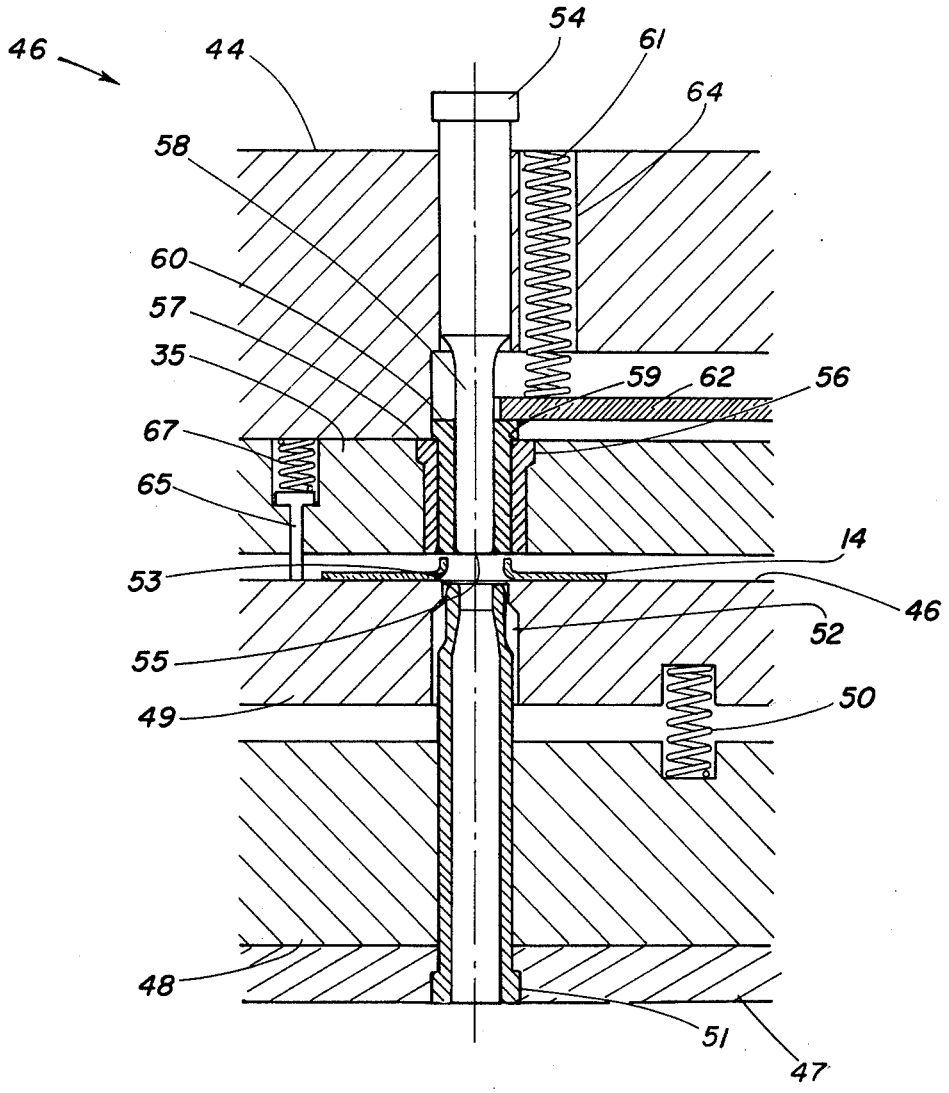
FIG. 2 is an enlarged fragmentary cross-sectional view of the compound collar straightening and pierce station in the open position of the progressive fin die shown in FIG. 1.

Pierce punch 54 has a reduced diametered portion 58 extending through and spaced inwardly from collar straightening bushing 56. A cylindrical stripper bushing 59 is slidably mounted to the reduced diametered portion 58 of punch 54. The enlarged top end 60 of stripper bushing 59 limits the downward movement of the stripper bushing until the bottom end of the stripper bushing is flush with the bottom end 55 of punch 54. A helical spring 61 is received in cavity 64 of plate 44 and engages an intermediate member 62 in turn resting atop the enlarged top ends 60 of stripper bushings 59 and 63 (FIGS. 2 and 1). Stripper bushings 59 and 63 are therefore normally urged downwardly toward supporting surface 46 by spring 61.

Figure 3:
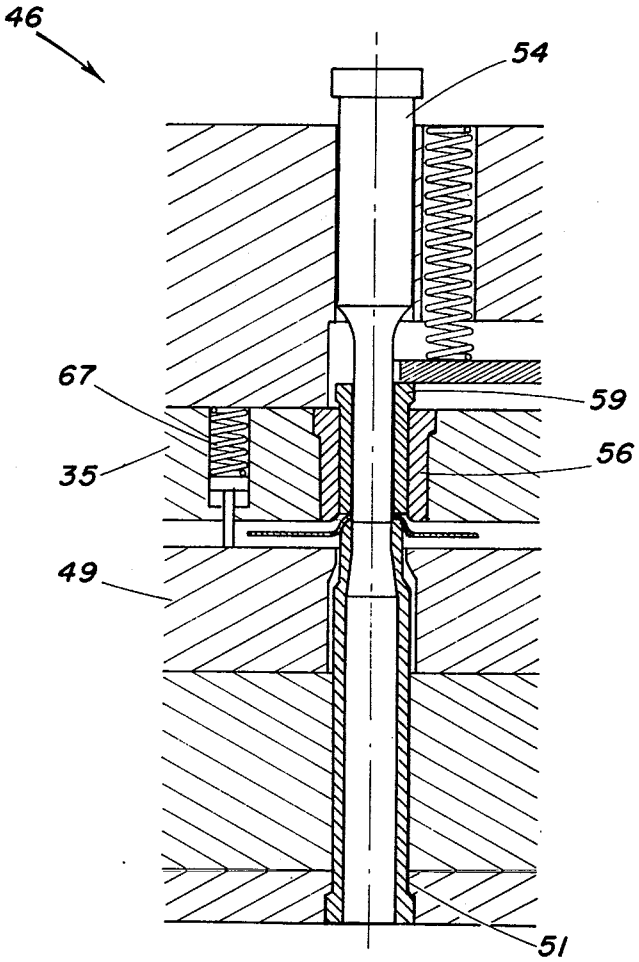
FIG. 3 is the same view as FIG. 2 only showing the die immediately prior to closure.
Figure 5:
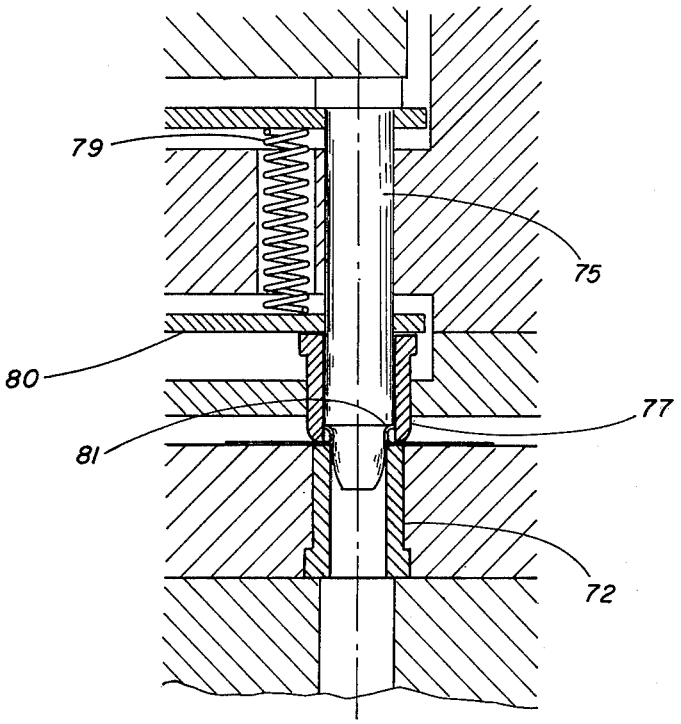
FIG. 5 is an enlarged fragmentary cross-sectional view of the reflare station of the progressive fin die shown in FIG. 1.

A pair of spring loaded pusher pins 65 and 66 are movably mounted in shoe 35 with each pusher pin having an enlarged top end abutting a pair of helical springs 67 and 68 received in a cavity closed by plate 44. The drawing is fragmented to show pins 65 and 66. Actually the pusher pins 65 and 66 are not in line with the punches and bushings of each successive work station in the die since otherwise they would trap the stock. The pins are actually positioned to each side of the stock being fed through the die. The pins do not contact the stock. When the progressive fin die is in the open position (FIG. 2), the bottom ends of pusher pins 65 and 66 extend outwardly toward bottom shoe 49. As the top shoe 35 moves toward the bottom shoe 49, the bottom ends of the pusher pins will eventually contact shoe 49 forcing shoe 49 against plate 48 and compressing spring 50. Thus, the top end of pierce bushing 51 will extend above the top surface 46 of shoe 49 and into the bonnet formed in sheet material 14. Further downward movement of the top die shoe results in the compression of springs 67 and 68 with the pusher pins then moving further into plate 35. Simultaneously, stripper bushings 59 and 63 (FIGS. 1 and 3) contact the top edge of the bonnets fomred in material 14 with further downward movement of the top die shoe resulting in the pierce punches extending through the bonnets and into the pierce bushing. Simultaneously, the collar straightening bushings 56 externally engage and straighten the collars in the workpiece shown in FIG. 4.

The pair of collar straightening bushings encircle the pierce punches with the stripper bushings 59 and 63 disposed between the collar straightening bushings and the pierce punches. Thus, as the die shoes are moved apart, spring 61 urges intermediate member 62 and the stripper bushings 59 and 63 downwardly thereby forcing the workpiece from the collar straightening bushings while simultaneously cleaning the pierce punches of any metal particles resulting from the piercing of the bonnets. The stripper bushings 59 and 63 fill the space between the pierce punch and collar straightening bushings preventing the accumulation of metal particles.

Once the bonnets are pierced and the collars formed, the collared holes are moved to reflare station 70 which includes a pair of reflare bushings 71 and 72 fixedly mounted to plate 73 attached to the bottom shoe. A pair of reflare punches 74 and 75 are fixedly mounted to the top shoe and extend downwardly through a pair of stripper bushings 76 and 77 slidably mounted to the top shoe and urged downwardly by a pair of helical springs 78 and 79 contacting an intermediate member 80 disposed between the springs and the stripper bushings. The reflare punches 74 and 75 are mounted to the top shoe opposite the reflare bushings 71 and 72 and are sized to extend through the collared holes into the reflare bushings. Each reflare punch is provided with a radiused surface 81 for contacting the top edges of the collars extending around the holes in sheet 14 so as to curl the top edge of the collars outwardly. The reflare stripper bushings 76 and 77 encircle the reflare punches 74 and 75 with the helical springs being operable to force the sheet of material 14 from the reflare punches as the reflare punch is withdrawn from the collared holes and the die shoes moved apart.

The sheet of material 14 is moved through the progressive fin die by feed device 16 which is operable to engage the collared holes of the workpiece and force the workpiece across surface 46 of the bottom shoe in timed relationship to vertical movement of the ram. A variety of feed devices may be utilized to force the sheet of material through the progressive fin die. Such a feed device used with the present embodiment is disclosed in my U.S. Pat. No. 3,780,561, which is hereby incorporated by reference. Other feed devices which may be used with the invention disclosed herein are the feed devices disclosed in my U.S. Pat. Nos. 3,815,803 and 3,874,216, which are incorporated by reference.

Subsequent to the formation of the reflared or curled collared holes in material 14, the sheet material is moved to station 82 and then to station 83 where the material is respectively cut and trimmed. Conventional cutters and edge trimmers are commercially available for stations 82 and 83. A cut-off station 84 is provided at the end of the progressive fin die to separate the sheet of material 14 into a plurality of individual fins.

It will be obvious that the present invention provides several advantages as compared to the prior progressive fin dies. First, the new progressive fin die produces a collared hole of superior dimensional characteristics. The dimensional uniformity from collar to collar is excellent resulting in a reduction of the assembly time for inserting coolant tubes through the fin collars. Further, the uniformity from fin to fin and from collar to collar will provide a heat transfer coil of superior heat transfer performance and appearance. Further, the self-cleaning feature of the stripper bushing associated with the compound collar straightening and pierce station provides for a longer die service life and reduced service cost.

In the prior art compound collar straightening and pierce stations, metal particles resulting from the piercing are allowed to accumulate between the straightening bushings and pierce punch resulting in the eventual breakage of the pierce punch. An advantage in the present device is the improved fin appearance with the elimination of the dimples resulting from the prior art spring loaded stripper pins. The present invention provides for a positive and distortion-free removal of the fin stock from the various punches and bushings allowing for a smoother progression of sheet material through the die and allowing for higher speeds enabling greater productivity. Another advantage of the present invention is the ability to produce higher fin collars using thinner materials and/or stock lubricants of lower quality.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. The combination of a stripper device with a die for forming a hole in a workpiece comprising:

a frame including a surface for supporting a workpiece and a ram movable to and from said surface;

a hollow bushing fixedly mounted to said frame;

a punch fixedly mounted to said frame and sized to force a portion of said workpiece in said bushing when said ram moves toward said surface;

a stripper rod mounted to said frame and being positioned within said bushing;

spring means engaged with said frame and said rod being operable to urge said rod through said bushing to force said portion of said workpiece therefrom as said ram moves away from said surface but being yieldable to allow said rod to withdraw within said bushing as said portion of said workpiece is forced into said bushing by said punch;

a plurality of punches mounted to said frame in a row with said punches arranged with decreasing diameters in said row;

a plurality of bushings mounted to said frame in a row opposite said punches with said bushings arranged with decreasing internal diameters to cooperatively with said punches form a bonnet in said workpiece of decreasing diamater as said bonnet is moved along said row and engaged successively by some of said punches and bushings;

a hollow pierce bushing mounted to said frame;

a pierce punch mounted to said frame being extendable through said workpiece and into said pierce bushing;

a stripper bushing slidably disposed around and encircling said pierce punch;

spring means engaged with said frame and said stripper bushing being operable to force said workpiece from said pierce punch as said pierce punch is withdrawn from said workpiece.

* * * * *